United States Patent [19]

Durieux

[11] Patent Number: 4,560,324

[45] Date of Patent: Dec. 24, 1985

[54] AUTOMATIC PURGER FOR A HYDRAULICALLY CONTROLLED DOUBLE DIAPHRAGM PUMP

[75] Inventor: Francois P. Durieux, Aurec-sur-Loire, France

[73] Assignee: Clextral, Courbevoie, France

[21] Appl. No.: 737,975

[22] Filed: May 23, 1985

[30] Foreign Application Priority Data

May 25, 1984 [FR] France ..... 84 08222

[51] Int. Cl.[4] ..... F04B 43/06

[52] U.S. Cl. ..... 417/383; 417/385; 417/389; 92/97; 92/79; 137/197

[58] Field of Search ..... 417/383, 385, 386, 387, 417/388, 389; 92/97, 79, 80; 137/197

[56] References Cited

U.S. PATENT DOCUMENTS

| | | | |
|---|---|---|---|
| 2,619,177 | 12/1952 | La Point | 92/97 X |
| 2,827,853 | 3/1958 | Bradley | 417/383 X |
| 2,902,936 | 9/1959 | Bradley | 417/383 X |
| 3,030,892 | 4/1962 | Piccardo | 417/383 |
| 3,036,526 | 5/1962 | Hise | 417/388 X |
| 3,149,758 | 9/1964 | Rush et al. | 222/189 |
| 3,431,823 | 3/1969 | Orlita | 92/79 |
| 3,605,566 | 9/1971 | Vetter | 92/97 X |
| 3,623,700 | 11/1971 | Boteler | 92/79 X |

FOREIGN PATENT DOCUMENTS

| | | | |
|---|---|---|---|
| 991992 | 11/1951 | France . | |
| 1303272 | 7/1962 | France . | |
| 637589 | 5/1950 | United Kingdom | 417/386 |
| 1018279 | 1/1966 | United Kingdom . | |
| 2042918 | 10/1980 | United Kingdom . | |

*Primary Examiner*—Leonard E. Smith

*Attorney, Agent, or Firm*—Pollock, Vande Sande & Priddy

[57] ABSTRACT

The automatic purger has an intermediate chamber (11) one of the walls of which is formed by an elastic diaphragm (10), termed front diaphragm, whereas the other wall is formed by a second elastic diaphragm (12), termed rear diaphragm. This chamber is connected to a purger (20) formed by a body (21) defining a small internal enclosure (22) in which an element (25), which is highly permeable to the gas, is disposed. The invention is applicable to a hydraulically controlled or actuated pump of the reciprocating or displacement type.

5 Claims, 1 Drawing Figure

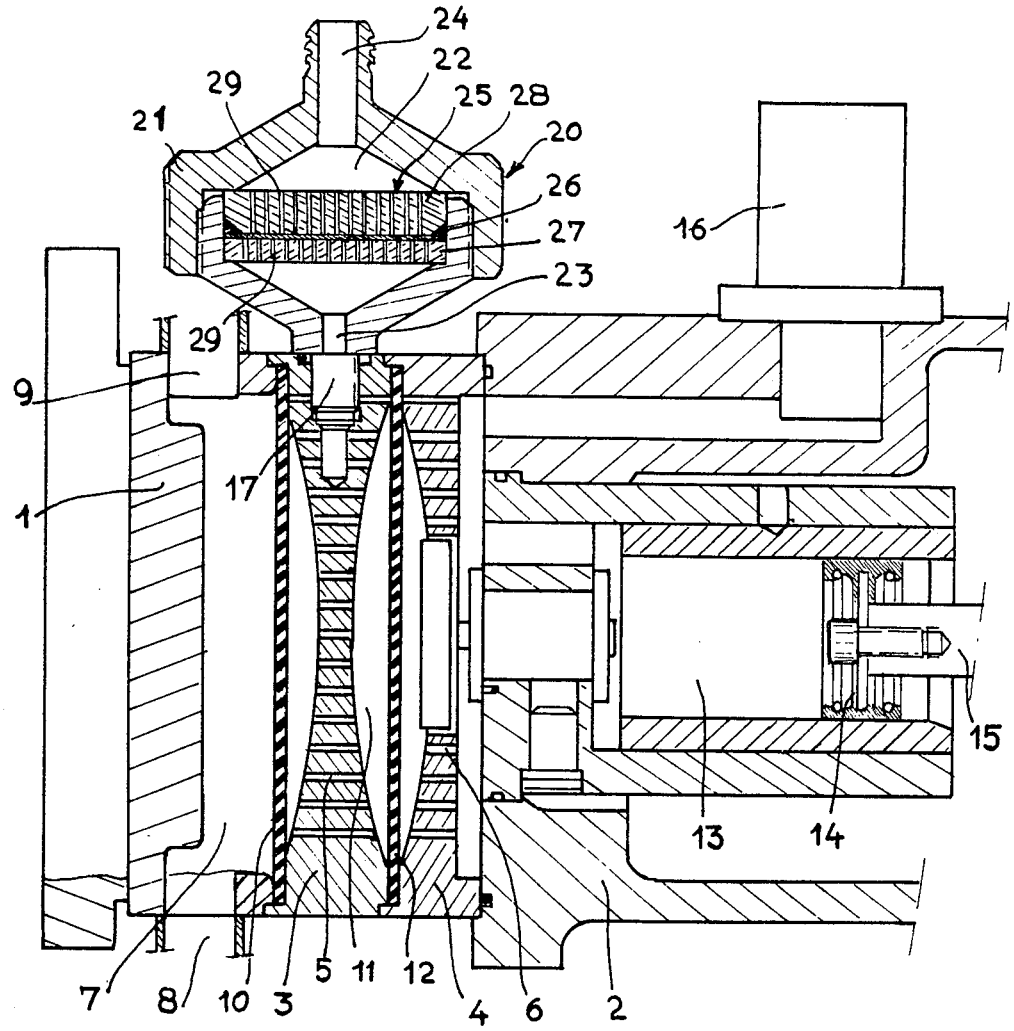
24
22
29
25
28
21
20
26
27
16
23
29
9
17
1
15
13
14
7
8
10
3
5
11
12
4
6
2

AUTOMATIC PURGER FOR A HYDRAULICALLY CONTROLLED DOUBLE DIAPHRAGM PUMP

The present invention relates to an automatic purger for a double diaphragm pump controlled or actuated hydraulically of the reciprocating or displacement type.

This type of pump usually comprises a pumping chamber formed by an elastic diaphragm termed front diaphragm and two check valves, one for the suction and the other for the delivery. The variation in the volume of this pumping chamber is achieved by a to-and-fro movement of a piston whose travel and frequency are determined and adjustable in accordance with the desired output of the pump. The increase in the volume of the pumping chamber, which is achieved by a retraction of the front diaphragm, causes the arrival of the liquid through the suction valve and the decrease in the volume, achieved by moving the front diaphragm forwardly, causes the discharge of the pumped liquid through the delivery valve.

The transmission of the movement of the piston to the front diaphragm is ensured by a hydraulic transmission, this transmission comprising, on one hand, an intermediate chamber filled with fluid defined by a fixed enclosure of which one longitudinal end wall is formed by the front diaphragm while another wall is formed by a second elastic diaphragm, termed the rear diaphragm, and, on the other hand, a pulse chamber also filled with liquid between said rear diaphragm and the piston. The quantity of fluid, for example fluid mineral oil, in the intermediate chamber is fixed once and for all when the pump is started up, so that the two diaphragms are substantially parallel.

But this type of double diaphragm pump has a drawback. Indeed, it is found that in certain cases the liquid drawn into the pumping chamber contains dissolved gas, for example hydrogen. Now, it is known that it is extremely difficult to produce elastic diaphragms which are completely impermeable to the gas, so that the gas diffuses through the front diaphragm and enters the intermediate chamber. Owing to the density of the oil contained in the intermediate chamber, the gas is trapped inside said chamber where it gathers in the form of droplets in the upper part. Consequently, at the end of a certain period of utilization, the efficiency of the pump diminishes.

An object of the invention is therefore to overcome these drawbacks by providing an automatic purger, which is cheap to manufacture, reliable, simple in operation, and ensures the maintenance of the efficiency of the pump.

According to the invention, the intermediate chamber communicates with a purger constituted by a body defining a small internal enclosure in which is disposed an element which is highly permeable to the gas.

There will now be described by way of a non-limiting example a preferred embodiment of the invention with reference to the single accompanying drawing, which is a longitudinal sectional view of a double diaphragm pump provided with an automatic purger according to the invention.

In the FIGURE, there is shown a hydraulically controlled double diaphragm pump constituted by a housing 1, assembled in a sealed manner with the pump body 2 with interposition of an intermediate plate 3 and a grate 4. The intermediate plate 3 and the grate 4 are provided with orifices 5 and 6 for the passage of a fluid.

Formed inside the housing 1 is a pump chamber 7 comprising a supply conduit 8 and a delivery conduit 9 provided with a check valves (not shown). The pumping chamber 7 is defined by an elastic diaphragm 10, termed front diaphragm, whose annular edge porton is clamped between the housing 1 and the intermediate plate 3.

The front diaphragm 10 also constitutes one of the longitudinal end walls of an intermediate chamber 11 in which the intermediate plate 3 is inserted and whose other longitudinal end wall is formed by a second elastic diaphragm 12, termed rear diaphragm. The annular edge portion of this rear diaphragam is clamped between the intermediate plate 3 and the grate 4. The intermediate chamber 11 is filled with a suitable liquid, for example a fluid mineral oil.

Arranged behind the rear diaphragm 12 and in the pump body 2 is a pulse chamber 13 filled with a driving fluid and in which moves a piston 14 driven by means of a piston carrier 15 in a reciprocating movement by a device (not shown). The pulse chamber 13 comprises a safety valve 16.

The intermediate chamber 11 is connected by an opening 17 to a purger designated by the reference numeral 20. This purger is mounted on the outer periphery of the intermediate plate 3 and comprises a body 21 defining a small internal enclosure 22. This enclosure is connected on one side to the opening 17 of the intermediate plate 3 through a small orifice 23, and on the other side communicates through a passage 24 either with the atmosphere, or with a gas recuperation device (not shown).

The enclosure 22 comprises an element 25 which is highly permeable to the gas and in particular hydrogen, and which divides said chamber into two independent cavities. This element 25 is formed by a permeable diaphragm 26 disposed between two grates 27 and 28. The grates 27 and 28 have a multitude of small channels 29 which are arranged in such manner as to cover the largest possible area of the diaphragm 26 so as to obtain a great diffusion of the gas. These two grates also immobilize the diaphragm 26. The fluid contained in the intermediate chamber 11 also fills the lower cavity of the enclosure 22, the diaphragm 26 affording the fluid-tightness.

In operation, the to-and-fro movement of the piston 14, whose travel and frequency are determined and adjustable in accordance with the desired output of the pump, causes, through the intermediary of the fluid in the pulse chamber 13 and intermediate chamber 11, the rear movement of the front diaphragm 10, the increase in the volume of the pumping chamber 7 and consequently the arrival of the liquid through the supply conduit 8. Then, the decrease in the volume of the pumping chamber 7, produced by the advancing movement of the front diaphragm 10, causes the discharge of the pumped liquid through the delivery conduit 9.

The gas, for example hydrogen, contained in the pumped liquid, is diffused through the front diaphragm 10 and enters the intermediate chamber 11. Inside this chamber, the gas, in the form of droplets, has a tendency to rise so that it enters through the opening 17 and the orifice 23 the lower cavity of the enclosure 22. The gas thus collected is distributed in the small channels 29 of the grate 27, travels through the diaphragm 26 which has a large coefficient of porosity, and then escapes through the small channels 29 of the grate 28 and through the passage 24.

This simple and reliable device permits a continuous and automatic elimination of the gas which is liable to enter the intermediate chamber and consequently the maintenance of the performances of the pump. Further, the highly permeable element disposed in the purger may also be formed by a sintered "Teflon" block which is permeable to the gas.

It must be understood that the scope of the invention is not limited to the details of the embodiment just described, since other arrangements may obviously be employed without departing from the scope of the invention defined in the claims.

What is claimed is:

1. An automatic purger for a hydraulically controlled double diaphragm pump which comprises a pumping chamber defined by a first elastic diaphragm, inlet and delivery conduits provided with valves, connected to the pumping chamber, an intermediate chamber which is filled with fluid and is defined by a wall formed by said first diaphragm and another wall formed by a second diaphragm, a pulse chamber also filled with fluid and a piston movably mounted in said pulse chamber for undergoing a reciprocating motion therein, said purger comprising a body defining a small enclosure which communicates with said intermediate chamber and encloses an element highly permeable to the gas.

2. An automatic purger according to claim 1, wherein the permeable element divides said enclosure into an upper cavity and a lower cavity, means defining a small orifice connects said lower cavity to said intermediate chamber, and means defining a passage connects said upper cavity to the atmosphere or to a gas recuperation device.

3. An automatic purger according to claim 1, comprising two grates, said element permeable to the gas being constituted by a third diaphragm having a high coefficient of porosity to the gas and being disposed between the two grates.

4. An automatic purger according to claim 3, wherein said grates are provided with a multitude of small vertical channels which are so distributed as to cover the greatest possible area of said third diaphragm, so as to achieve a large diffusion of the gas through said third diaphragm.

5. An automatic purger according to claim 2, wherein said element which is highly permeable to the gas is formed by a sintered "Teflon" block permeable to the gas.

* * * * *